US005568398A

United States Patent [19]

Trainor

[11] Patent Number: 5,568,398

[45] Date of Patent: Oct. 22, 1996

[54] ELECTRONIC OPERATIONS COUNTER FOR A VOLTAGE REGULATOR CONTROLLER

[75] Inventor: John J. Trainor, Wake Forest, N.C.

[73] Assignee: Siemens Energy & Automation, Inc., Alpharetta, Ga.

[21] Appl. No.: 165,147

[22] Filed: Dec. 10, 1993

[51] Int. Cl.[6] ..... G06G 7/63; G05F 1/14

[52] U.S. Cl. ..... 364/492; 364/480; 364/551.01; 395/750; 323/255

[58] Field of Search ..... 364/492, 483, 364/480, 551.01; 395/750; 323/255–258, 340–343, 235, 319; 327/79

[56] References Cited

U.S. PATENT DOCUMENTS

| | | | |
|---|---|---|---|
| 4,370,723 | 1/1983 | Huffman et al. | 364/483 |
| 5,027,285 | 6/1991 | ScCartney et al. | 364/483 |
| 5,315,533 | 5/1994 | Stich et al. | 364/483 |

*Primary Examiner*—Emanuel T. Voeltz
*Assistant Examiner*—Kyle J. Choi

[57] ABSTRACT

A voltage regulator controller of a step-type voltage regulator monitors its own power supply and saves the regulators operations count to a non-volatile memory, only when it is determined that a power failure is imminent. The controller counts the number of tap changes in the voltage regulator transformer by monitoring an "operations counter" signal from the regulator's tap changer mechanism. When a tap change is detected, the controller increments an electronically stored count value. The electronically stored count value is maintained exactly, even when the power to the device is lost. In order to determine whether a power failure is imminent, the controller monitors the AC supply voltage using a zero-crossing detector circuit. The zero crossing detector circuit produces transitions corresponding to transition in the AC power waveform. The zero crossing circuit stops producing transition when the AC voltage falls below a predetermined threshold. A monitoring program determines when the zero-crossing detector has stopped producing transitions and causes the control program to initial a power down sequence. The power down sequence provides an orderly shut down of the microprocessor program tasks and finishes by storing the value of the operations counter to a non-volatile memory. The power supply maintains its level for a significant time after the AC voltage waveform drops below the predetermined threshold. This gives the microprocessor time to detect that zero transitions have ceased and to store the operations counter value.

12 Claims, 9 Drawing Sheets

ELECTRONIC OPERATIONS COUNTER FOR A VOLTAGE REGULATOR CONTROLLER

BACKGROUND OF THE INVENTION a. Field of the Invention

This invention relates to voltage regulators and related control systems.

b. Related Art

A step-type voltage regulator is a device which is used to maintain a relatively constant voltage level in a power distribution system. Without such a regulator, the voltage level of the power distribution system could fluctuate significantly and cause damage to electrically powered equipment.

A step-type voltage regulator can be thought of as having two parts: a transformer assembly and a controller. A conventional step-type voltage regulator transformer assembly 102 and its associated controller 106 are shown in FIG. 1. The voltage regulator transformer assembly can be, for example, a Siemens JFR series. The windings and other internal components that form the transformer assembly 102 are mounted in an oil filled tank 108. A tap changing mechanism (not shown) is commonly sealed in a separate chamber in the tank 108.

The various electrical signals generated by the transformer are brought out to a terminal block 110 and external bushings S, SL, L for access. The terminal block is preferably covered with a waterproof housing. An indicator 112 is provided so that the position of the tap as well as its minimum and maximum positions can be readily determined.

A cabinet 114 is secured to the tank to mount and protect the voltage regulator controller 106. The cabinet 114 includes a door (not shown) and is sealed in a manner sufficient to protect the voltage regulator controller 106 from the elements. Signals carried between the transformer or tap changing mechanism and the voltage regulator controller 106 are carried via an external conduit 116.

The tap changing mechanism is controlled by the voltage regulator controller 106 based on the controller's program code and programmed configuration parameters. In operation, high voltage signals generated by the transformer assembly 102 are scaled down for reading by the controller 106. These signals are used by the controller 106 to make tap change control decisions in accordance with the configuration parameters and to provide indications of various conditions to an operator.

The transformer assembly 102 typically includes a switch or counter which changes state each time a tap change is made. This switch or counter is monitored by the controller 106 which, in turn, uses the signal generated by the switch or counter to keep track of the total number of tap changes made by the transformer. In order to ensure that the tap change or "operations" count is maintained in the event of a power loss, the controller may periodically store the count in a non-volatile memory such as an electrically erasable programmable read only memory (EEPROM).

One limitation of EEPROM technology is that it can only be written to a certain number of times before it wears out and the device fails. To avoid the wear out problem, a controller may store the operations count to EEPROM after a given number of tap changes (for example every 20 counts). A problem with this method is that an operations counter can suffer significant inaccuracies, especially for systems that lose power frequently.

SUMMARY OF THE INVENTION

In accordance with the present invention, a voltage regulator controller monitors the power supply and saves the operations count when it is determined that a power failure is imminent. The controller counts the number of tap changes in the voltage regulator transformer by monitoring an "operations counter" signal from the tap changer mechanism. When a tap change is detected, the controller increments an electronically stored count value. The electronically stored count value is maintained exactly, even when the power to the device is lost.

In a preferred embodiment, the voltage regulator controller looks for and counts transitions on the operations counter signal from the voltage regulator transformer assembly. The controller also monitors the AC supply voltage using a zero-crossing detector circuit. The zero crossing detector circuit produces transition corresponding to transition in the AC power waveform and stops producing the transitions when the AC voltage falls below a predetermined threshold.

A monitoring program determines when the zero-crossing detector has stopped producing transitions and causes the control program to initiate a power down sequence. The power down sequence provides an orderly shut down of the microprocessor program tasks and finishes by storing the value of the operations counter to a non-volatile memory.

The power supply maintains its level for a significant time (e.g. >90 msec) after the AC voltage waveform drops below the predetermined threshold. This gives the microprocessor time to detect that zero cross transitions have ceased and to store the operations counter value.

BRIEF DESCRIPTION OF THE DRAWINGS

FIG. 6 is a diagram showing how the sheets comprising FIGS. 6A and 6B should be joined;

Like reference numerals appearing in more than one figure represent like elements.

DETAILED DESCRIPTION OF THE PREFERRED EMBODIMENT

An embodiment of the present invention will now be described by reference to FIGS. 2 through 8.

Figure 3:
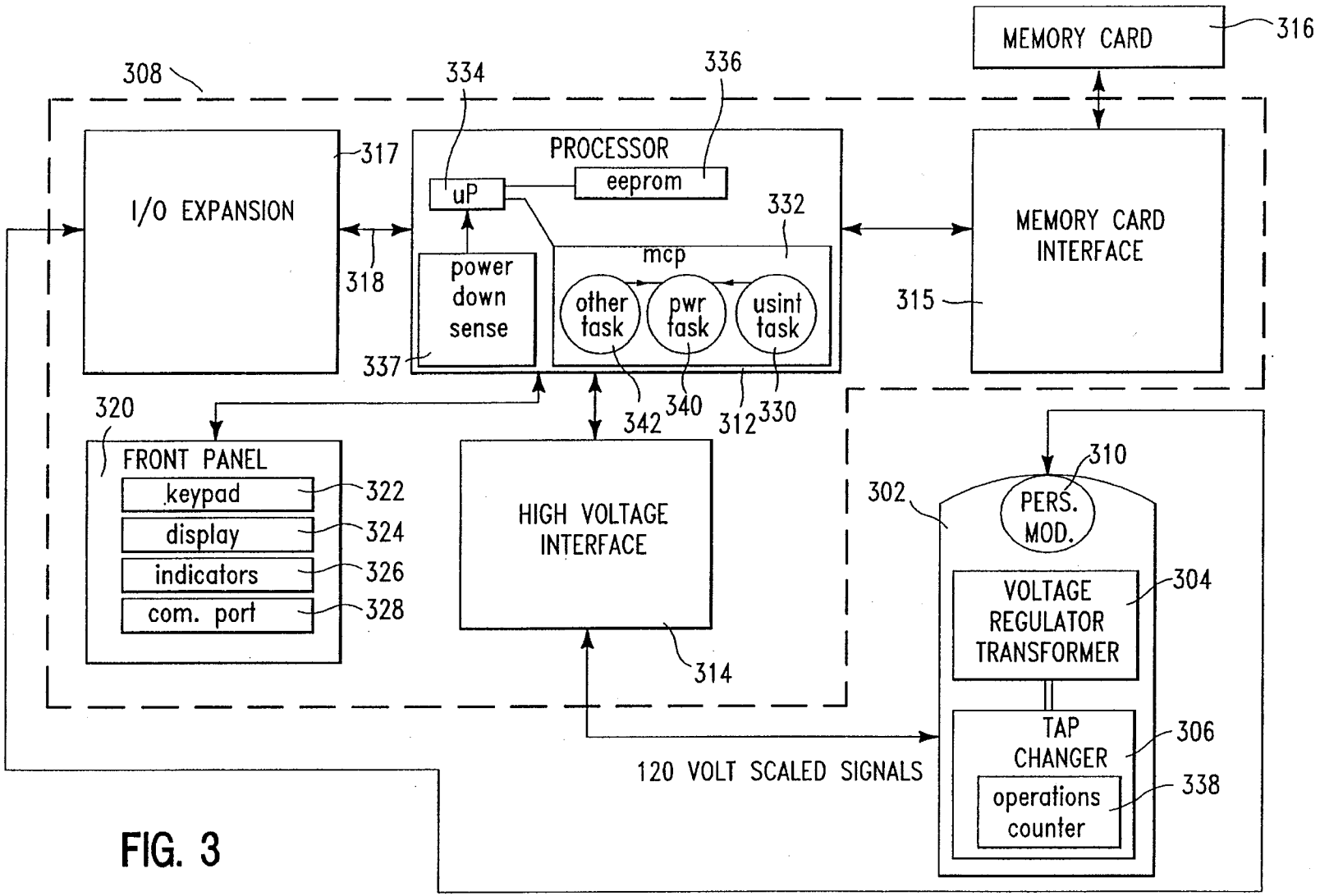
FIG. 3 is a block diagram of a voltage regulator controller in accordance with an embodiment of the present invention.

A step-type voltage regulator and its associated controller according to an embodiment of the present invention are shown in FIG. 3. The voltage regulator transformer assembly 302 can be, for example, a Siemens JFR series but in any event is of a conventional type which includes a multi-tap transformer 304 and an associated tap changer (tap changing mechanism) 306. The tap changer 306 is controlled by the voltage regulator controller 308 which receives signals indicative of voltage and current in the windings of the transformer 304 and conventionally generates tap control signals in accordance with operator programmed set-points and thresholds for these signals. The voltage regulator 302 can also be provided with a non-volatile memory (personality module) 310 which stores statistics and historical information relating to the voltage regulator.

The voltage regulator controller 308 includes a processor section (processor board) 312, a high voltage interface 314, a PCMCIA memory card interface 315 (for receiving a conventional PCMCIA standard memory card 316), an I/O expansion chassis (rack) 317 which is coupled to the processor section 312 by way of a bus 318 and a front panel 320 which is coupled to the processor section.

The front panel 320 provides an operator interface including a keypad 322, a character display 324, indicators 326 for various regulator conditions and a serial communications port connector 328. A user interface task (usint) 330 running under the processor section's main control program (mcp) 332 monitors activity on the keypad 322 and provides responses to the character display 324 as needed. The front panel 320, its associated operator interface and the user interface task 330 can be of the type described in U.S. patent application Ser. No. 07/950,402; filed on Sep. 23, 1992, which is incorporated by reference in its entirety as if printed in full below.

The processor section 312 generates digital control signals based on internal program code and operator selected parameters entered (by an operator) via the controllers front panel 320. The processor section 312 is controlled by a microprocessor (up) 334. The microprocessor 334 is coupled to a serial electrically erasable read only programmable memory (EEPROM) 336 which stores the operations count and operator programmed configuration data. The microprocessor 334 is also coupled to a power down sensor 337 which is embodied using a zero-cross detector.

In operation, high voltage signals are generated by the voltage regulator transformer 304. These signals are scaled down via internal transformers (not shown) and provided to the high voltage interface 314. The high voltage interface 314, in turn, further scales the transformed down signals for reading by an analog to digital converter (shown in FIG. 4) within the processor section 312. The data fed back from the voltage regulator 402 is used by the processor section 312 to make tap change control decisions and to provide indication of various conditions to an operator.

In accordance with an embodiment of the present invention, the processor board senses an "Operations Counter" signal from the transformer assembly 304. The Operations Counter signal is generated by an electronic switch (operations counter switch) 338 located on the tap changer mechanism 306. Each time the tap position changes, the operations counter switch 338 is toggled from one position to the other. If the switch 338 is open before the tap change, it closes as the tap change occurs; and vice-versa.

In addition to the user interface task 330, the microprocessor also executes a power monitoring task (pwr task) 340 which runs under the main control program 332. The pwr task 332 monitors the power down sensor 337. If a power loss is detected, the pwr task 340 initiates a power down sequence which shuts off or suspends all active tasks 330, 342 except itself. Shutting off active tasks has the benefit of prolonging the residual supply life (stored power in the power supplies internal capacitor) by reducing the current drain. After shutting off all other active tasks, the power down routine saves the operations counter value to the EEPROM 336.

Figure 1:
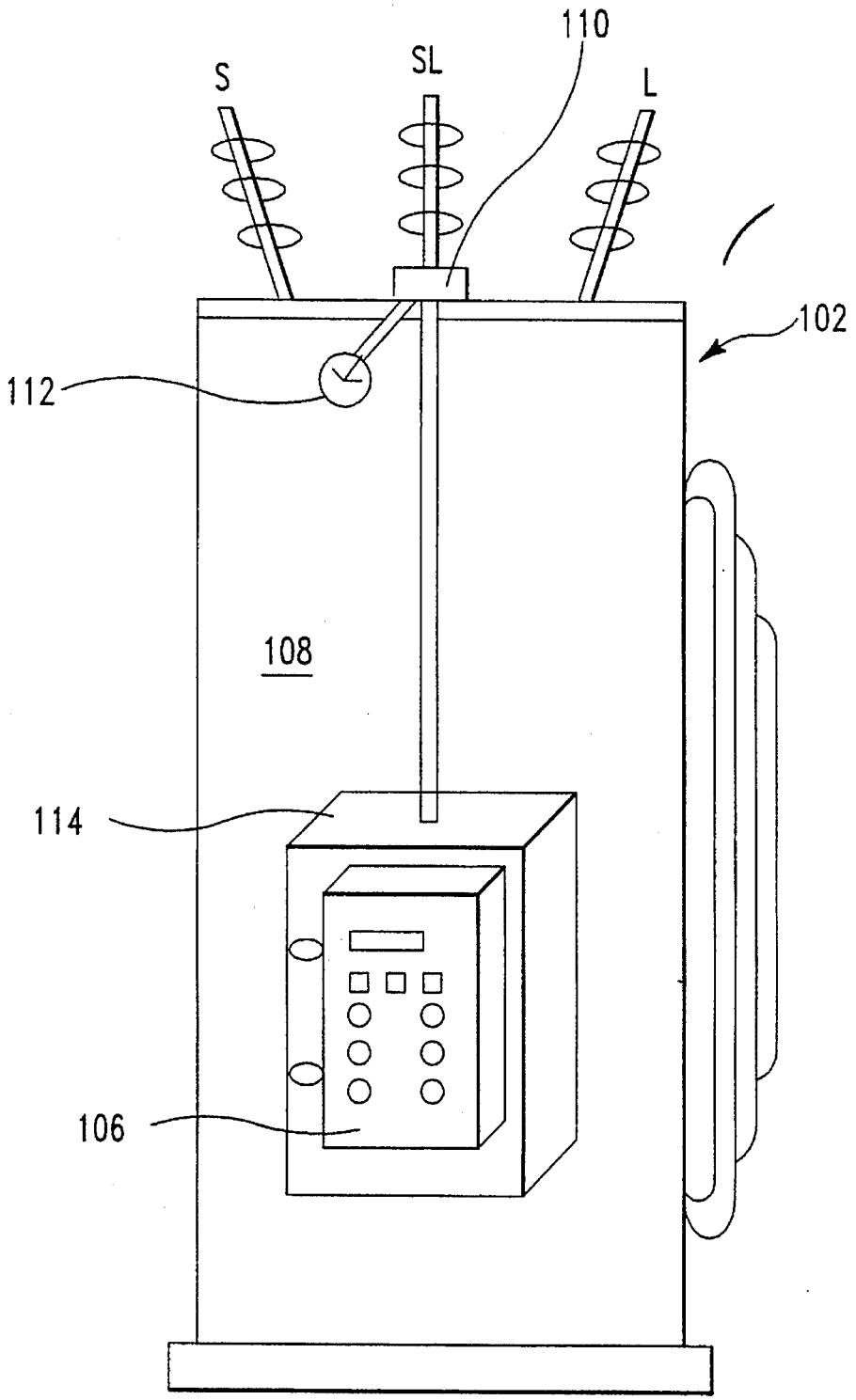
(PRIOR ART) FIG. 1
FIG. 1 shows a conventional voltage regulator transformer assembly and controller.
Figure 2:
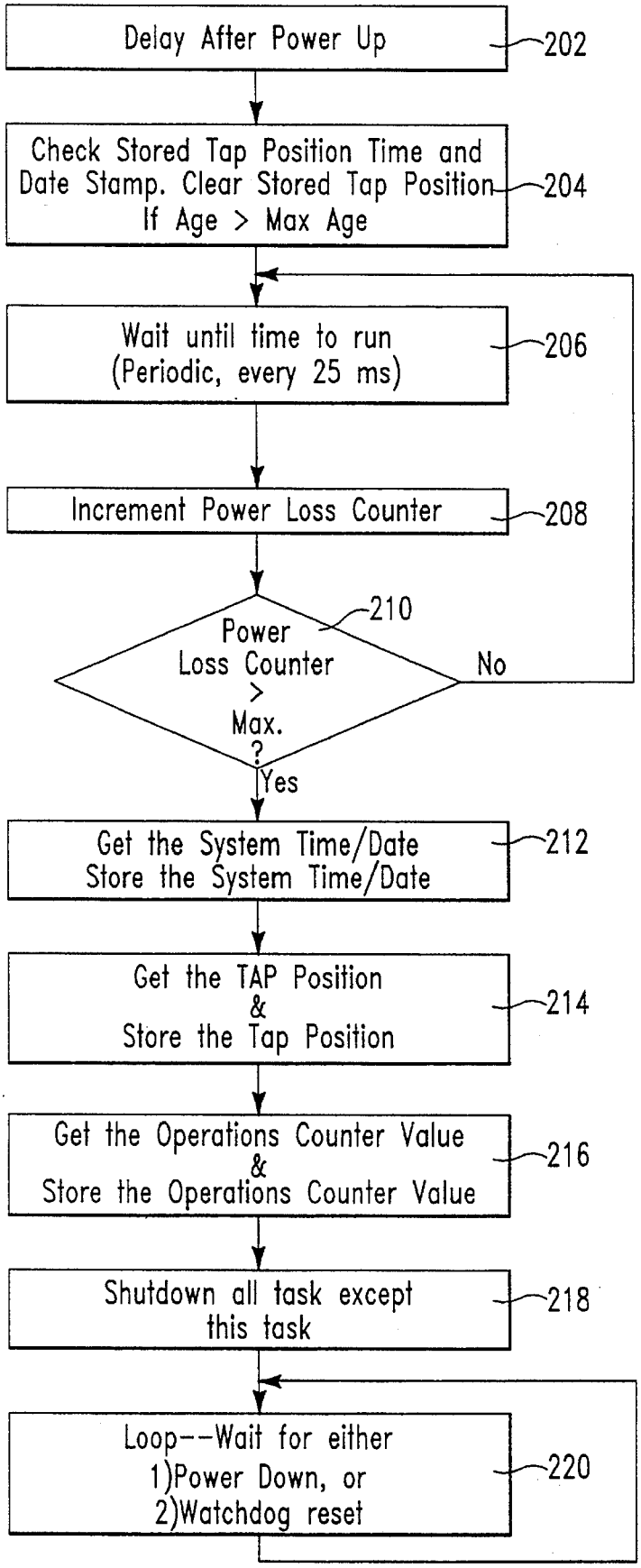
FIG. 2 is a flow chart of a power supply monitoring and shut down method according to an embodiment of the present invention.

The power monitoring task 340 will now be described in more detail by reference to FIG. 2.

At power up, the main control program 332 starts operating and it in turn starts up other tasks 330, 340, 342 including: metering, energy calculation, regulator (tap changer motor) control, tap position tracking, serial port communications, watchdog, and power monitoring.

The power monitoring task 340 starts off, in step 202, with a delay which allows the power supply and the detection circuits to stabilize after power is applied.

After the power-up delay, in step 204 the power monitoring task 340 checks a time and date stamp associated with the most recently stored tap position. If the time and date stamp indicates that the stored tap position is beyond a maximum age (e.g. 1 minute) the stored tap position is cleared.

In step 206, the periodic monitoring routine (steps 208–220 of the power monitoring task) awaits its turn for periodic execution. In the present embodiment, the periodic monitoring routine is executed by the microprocessor once every 25 milliseconds.

In step 208 the power monitoring task increments the value of a "Power Loss Counter". The "Power Loss Counter" is an internal count value that is incremented once each time the periodic power monitoring routine is executed. Then, in step 210 the power monitoring task compares the value of the power loss counter with a predetermined maximum allowed value. If the Power Loss Counter value ever exceeds its maximum allowed value, then the power monitoring task proceeds with its power down sequence.

While AC power is good, the power down sensor 337 generates periodic signals which interrupt the processor. For a 60 Hz signal, this occurs every 8.33 milliseconds. The microprocessor calls an interrupt service routine (the power down sensor interrupt service routine) to process these interrupt signals. The power down sensor interrupt service routine clears (resets) the "Power Loss Counter" to zero. With this action, the "Power Loss Counter" is prevented from reaching its maximum value while the AC power is good.

When AC power fails (is lost), the power down sensor 337 stops producing the periodic interrupt signals, so the power down sensor interrupt service routine is not called. The "Power Loss Counter" continues to increment until it exceeds its maximum value, at which point the power monitoring task 340 executes its power down sequence.

The power down sequence includes these steps: 1) get and store the time and date, 2) get and store the tap position, 3) get and store the operations counter value (in the serial EEPROM), 4) shut down all other active tasks, and 5) execute a tight program loop until either the power goes down or a watchdog reset occurs.

In step 212, the time and date are stored so that they can be used to determine how long the power outage lasted. (At power up, the value of the last power down time and date are checked against the current time and date.)

Then, in step 214, the tap position is stored (in the serial EEPROM 336 or another non-volatile memory) so that it can be maintained through a power outage. Since controllers are sometimes swapped from one regulator to another, the software imposes a time limit for keeping the old value of the tap position. This time limit is tested in step 204. If the power outage exceeds the time limit, the controller indicates that it has lost the tap position. This helps to ensure that a controller that has been swapped will not commence operation with data indicative of an inaccurate tap position.

In step 216, the total operations counter value is stored in the serial EEPROM 336 so that its value can be maintained precisely through the power outage. Writing the value to the serial EEPROM takes a certain minimum time period (typically 10 milliseconds for today's devices.)

In step 218, all other active tasks 312, 342 are shut down, including: metering, energy calculation, regulator (tap changer motor) control, tap position tracking, serial port communications, and watchdog.

The microprocessor includes a conventional watchdog timer which resets the microprocessor if it does not receive an "Operating Properly" signal within a given time period (about 8 seconds in the present embodiment). In other words, if any 8 second interval passes during which the "Operating Properly" signal has not been received, the watchdog timer will reset the microprocessor. Since the watchdog task provides the "Operating Properly" signal to the watchdog timer, disabling the watchdog task causes the periodic "Operating Properly" signal to cease.

In step 220, the processor executes a tight loop of instructions, waiting for either the power to go down or for a watchdog reset. If the power drop was very brief (on the order of a few AC line cycles), then the controller may not produce a normal power-up reset. Instead, the controller will generate a watchdog timer reset after a delay (of about 8 seconds.) If the power drop is greater than a few hundred milliseconds, then the controller will generate a normal power-up reset when power is re-applied.

In other words, if an A.C. power outage occurs for a sufficient length of time to cause the power down routine to shut-down the watchdog task, but is of a short enough duration to enable D.C. power to be maintained, the watchdog timer will not see the "Operating Properly" signal and it will reset the microprocessor. If a power down (the actual loss of D.C. power to the processor board) occurs after the watchdog task has been stopped but before the watchdog reset occurs, then the pending watchdog reset is prevented. The watchdog circuit is re-initialized when power is re-applied to the processor board.

In the present embodiment, the power monitor algorithm runs every 25 milliseconds, and the maximum "Power Loss Count" is 2. That means that it could take as long as 75 milliseconds for the controller to recognize a power loss. Once the controller recognizes power loss, it takes about 11 milliseconds to complete the power down sequence (which includes 10 milliseconds for writing to the serial EEPROM 336.) The controller maintains power to the logic supply for a minimum of 100 milliseconds after the AC power signal is removed.

The present invention may be embodied as an improvement to the base circuitry and programming of an existing microprocessor based voltage regulator controllers. An example of a controller having suitable base circuitry and programming is the Siemens MJX voltage regulator controller, available from Siemens Energy and Automation, Inc. of Jackson, Miss., U.S.A.

Figure 4:
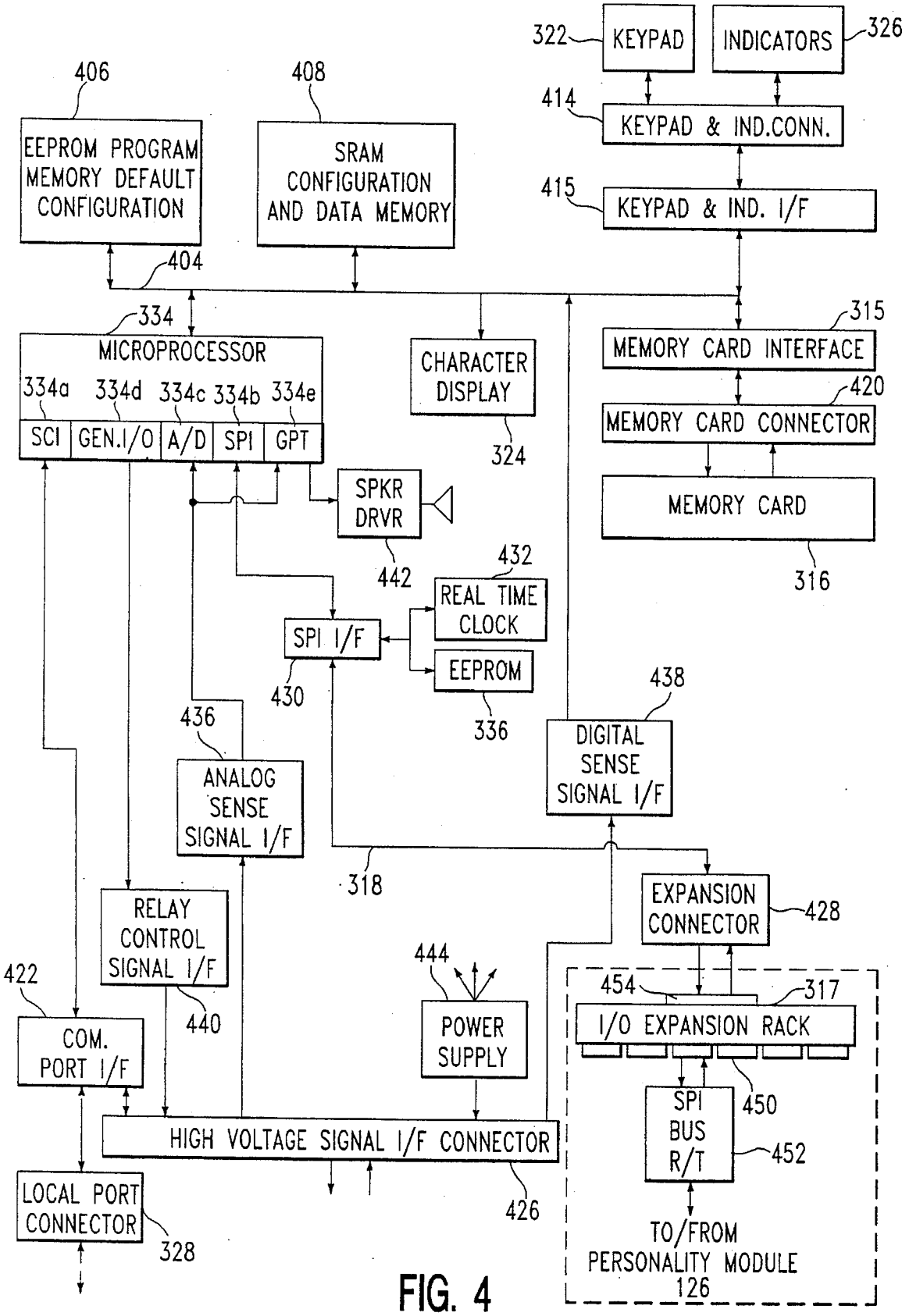
FIG. 4 is a more detailed diagram of the processor board of FIG. 3 showing its interconnection to other components of the voltage regulator controller.

A more detailed block diagram of the processor section 312 and its interconnection other elements of the voltage regulator controller is illustrated in FIG. 4.

The processor section 312 includes the microprocessor 334 (for example, a Motorola 68HC16) which is coupled to the other processor elements by way of a common bus 404. An electrically erasable programmable read only memory (EEPROM) 406 includes the microprocessor's program instructions and default configuration data.

A static type random access memory (SRAM) 408 stores operator programmed configuration data and includes areas for the microprocessor 334 to store working data and data logs.

The microprocessor 334 also communicates with the alphanumeric character display 324, the keypad 322 and indicators 326 and the memory card interface 315 via the bus 404.

The keypad 322 and indicators 326 are coupled to the bus 404 via a connector 414 and a bus interface 415. As previously described, a memory card 316 can be coupled to the bus 404 by way of a conventional PCMCIA standard interface 315 and connector 420.

Operational parameters, setpoints and special functions including metered parameters, log enables, log configuration data and local operator interfacing are accessed via the keypad 322. The keypad is preferably of the membrane type however any suitable switching device can be used. The keypad provides single keystroke access to regularly used functions, plus quick access (via a menu arrangement) to all of the remaining functions.

The microprocessor 334 includes an SCI port **334*a* which is connected to a communication port interface 422. The communication port interface 422 provides the SCI signals to the external local port 338 on the controller's front panel 320. An isolated power supply for the communication port interface 422 is provided by the high voltage interface 314 via a high voltage signal interface connector 426**.

The communication port interface 422 supports transfer of data in both directions, allowing the controller to be configured via a serial link, and also provides meter and status information to a connected device. In addition to supporting the configuration and data retrieval functions required for remote access, the communication port interface 422 supports uploading and/or downloading of the program code for the microprocessor 334.

The communication port interface 422 can be, for example, an RS-232 compatible port. The local port connector 424 can be used for serial communication with other apparatus, for example a palmtop or other computer. The physical interface of the local port connectors 328 can be a conventional 9-pin D-type connector whose pin-out meets any suitable industry standard.

The microprocessor 334 also includes a SPI port **334*b* which is connected to an expansion connector 428 by way of an SPI interface 430. The expansion connector brings the SPI bus 318 out to the I/O expansion chassis 317 via a cable. Other devices that reside on the SPI bus include a real time clock 432 and the serial EEPROM 336. The real time clock can be used to provide the time and date and data indicative of the passage of programmed time intervals. The serial EEPROM 336 stores operator programmed configuration data and the operations count. The operator programmed configuration data is downloaded to the SRAM 408 by the microprocessor 334 when the processor section 312 is initialized. The SRAM copy is used, by the microprocessor, as the working copy of the configuration data. The real time clock 432 is programmed and read by the microprocessor 334**.

The high voltage signal interface connector 426 provides a mating connection with a connector on the high voltage interface 314. Scaled analog signals from the high voltage interface 314 are provided to an A/D converter port 334*c* by way of an analog sense signal interface 436. The analog sense signal interface 436 low pass filters the scaled analog input signals prior to their provision to the A/D converter port 334*c*. Digital signals from the high voltage interface 314 are provided to the bus 404 via a digital sense signal interface 438. The digital sense signal interface 438 provides the proper timing, control and electrical signal levels for the data.

Control signals from the microprocessor's general I/O port 334*d* are provided to the high voltage signal interface connector 426 by way of a relay control signal interface 440. The relay control signal interface converts the voltage levels of the I/O control signals to those used by the high voltage interface 314. A speaker driver 442 is connected to the GPT port 334*e* of the microprocessor 334. The processor section 312 also includes a power supply 444 which provides regulated power to each of the circuit elements of the processor section 312 as needed. The high voltage interface 314 provides an unregulated power supply and the main 5 volt power supply for the processor section 312.

The microprocessor 334 recognizes that a memory card 316 has been plugged into the memory card interface 315 by monitoring the bus 404 for a signal so indicating. In response, the microprocessor 334 reads operator selected control parameters entered via the controller's keypad 322. Depending on the control parameters, the microprocessor either updates the programming code in its configuration EEPROM 406, executes the code from the memory card 316 while it is present but does not update its EEPROM 506, or dumps selected status information to the memory card 316 so that it can be analyzed at a different location. As an alternative embodiment, the processor section 312 can be programmed to default to the memory card program when the presence of a memory card is detected. In this case, upon detection, the program code from the memory card would be downloaded to the SRAM 408 and executed by the microprocessor from there.

The I/O expansion chassis (rack) 317 includes a number (e.g. 6) of connectors 450 for receiving field installable, plug-in I/O modules 452. The connectors 450 are electrically connected to the SPI bus 318 via a common processor section interface connector 554 and couple the I/O module(s) 452 to the SPI bus 318 when they are plugged into the chassis.

The processor section 312 can communicate with the personality module 310 in a number of ways. For example, the microprocessor 334 can be provided with conventional RS-232 interface circuitry to the SCI bus. A conventional RS-232 cable can then be used to connect this RS-232 interface to an RS-232 interface on the personality module. Alternatively, an I/O module (SPI BUS R/T) in the I/O expansion chassis can provide the physical and electrical interface between the SPI bus 318 and a cable connected to the personality module. An SPI R/T or other communications port can also be used to provide outside access to the controller's data logs and configuration parameters otherwise accessible on the front panel.

Figure 5:
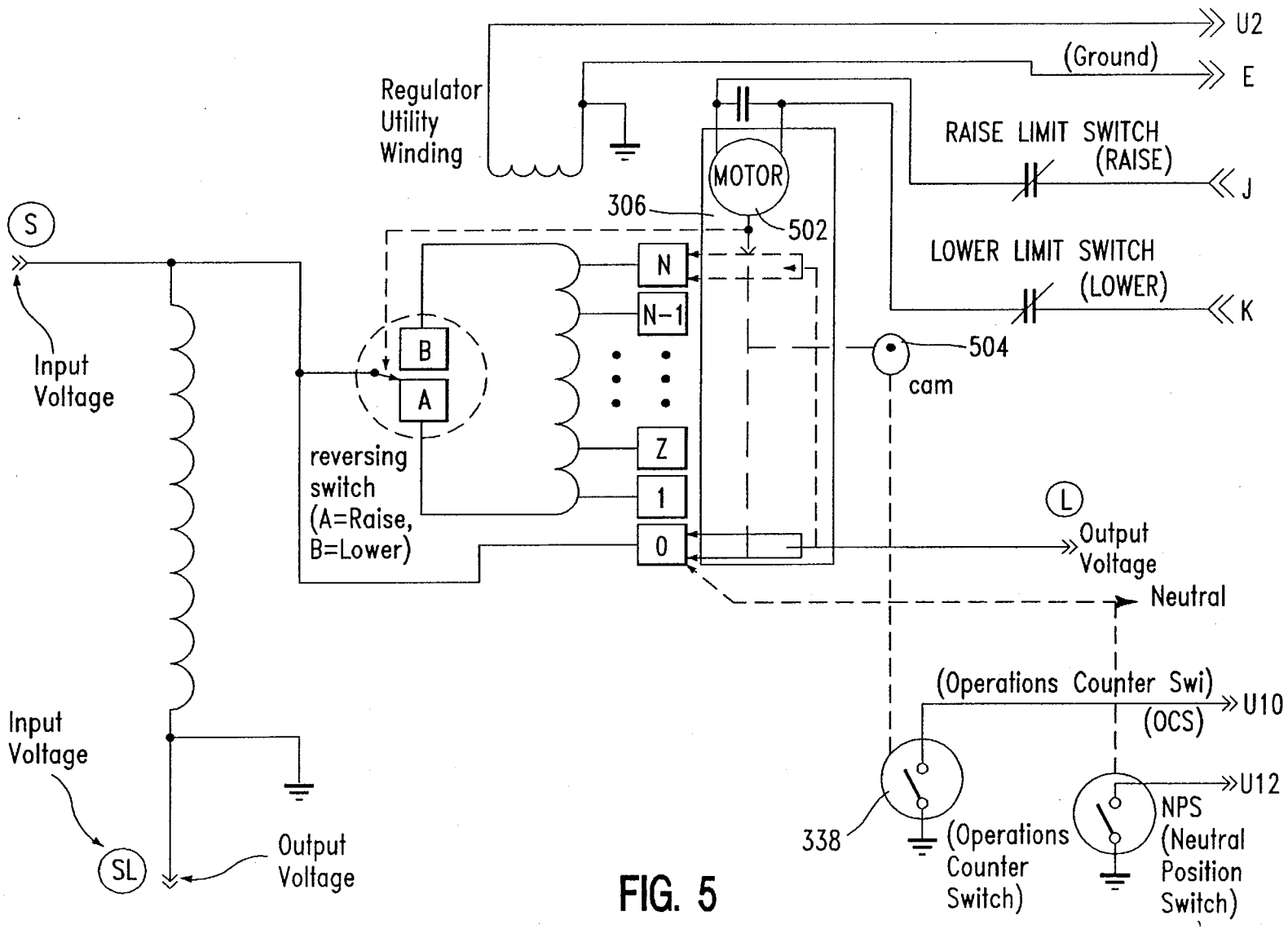
FIG. 5 is a more detailed diagram of the step-transformer, tap changing mechanism and operations counter of FIG. 3.

The tap changing mechanism, transformer and switch are shown in more detail in FIG. 5. The components of FIG. 5 are part of a conventional voltage regulator transformer assembly and thus, most will not be described in detail here. The tap changing mechanism 404 is operated by a stepper motor 502 which is in turn operated by way of raise (J) and lower (K) control signals. The operations counter switch 338 is operated by a cam 504 which rotates half a turn each time a tap change is made. One side of the switch 338 is connected to AC return ("E" ground). The Operations Counter signal that is input to the controllers is thus alternately (1) open circuit and (2) close closed to ground, each time a tap change occurs.

Figure 6A:
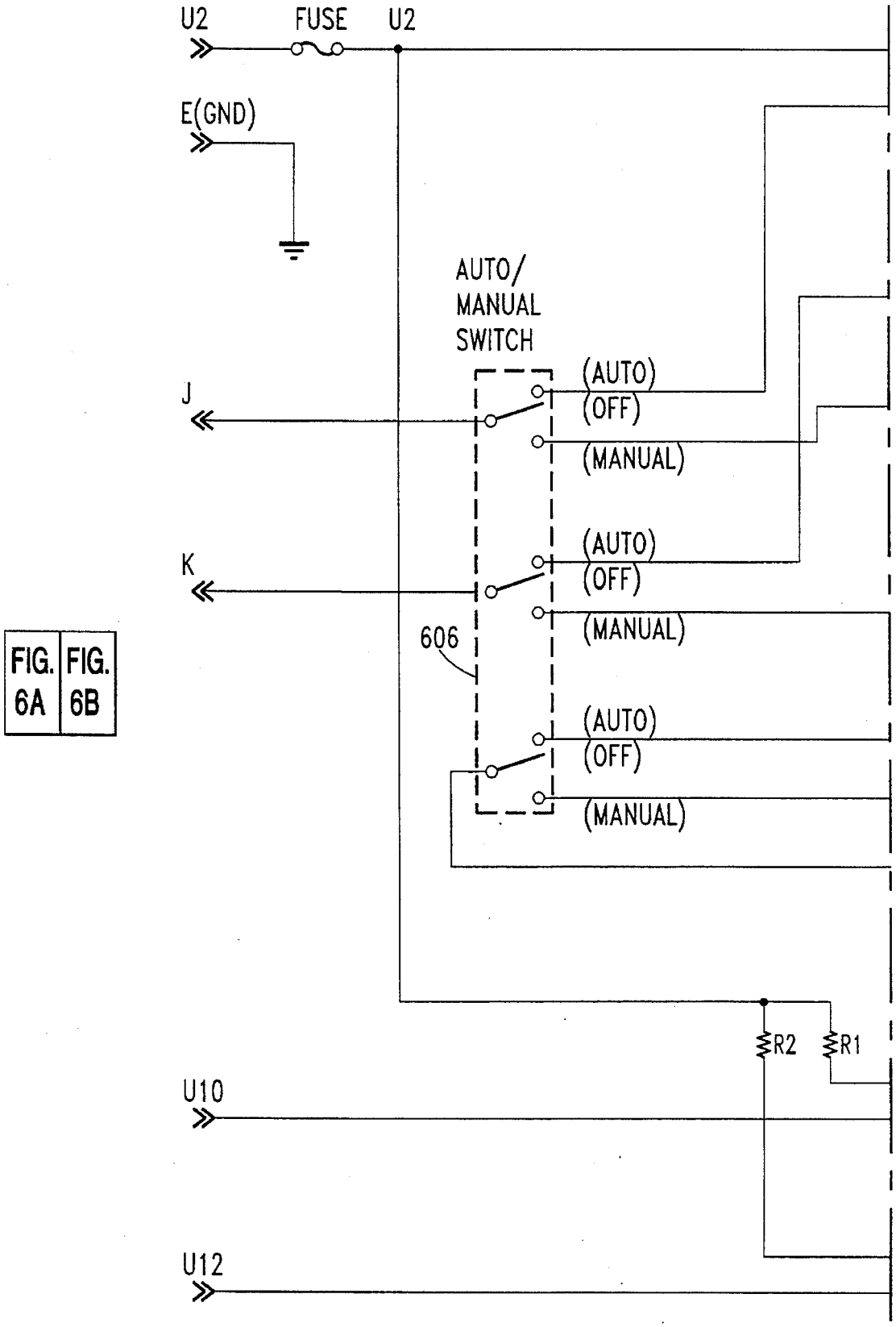
FIGS. 6*a* and 6*b*, which are joined as shown in FIG. 6, indicate a more detailed diagram of the High Voltage Interface board of FIG. 3.
Figure 6B:
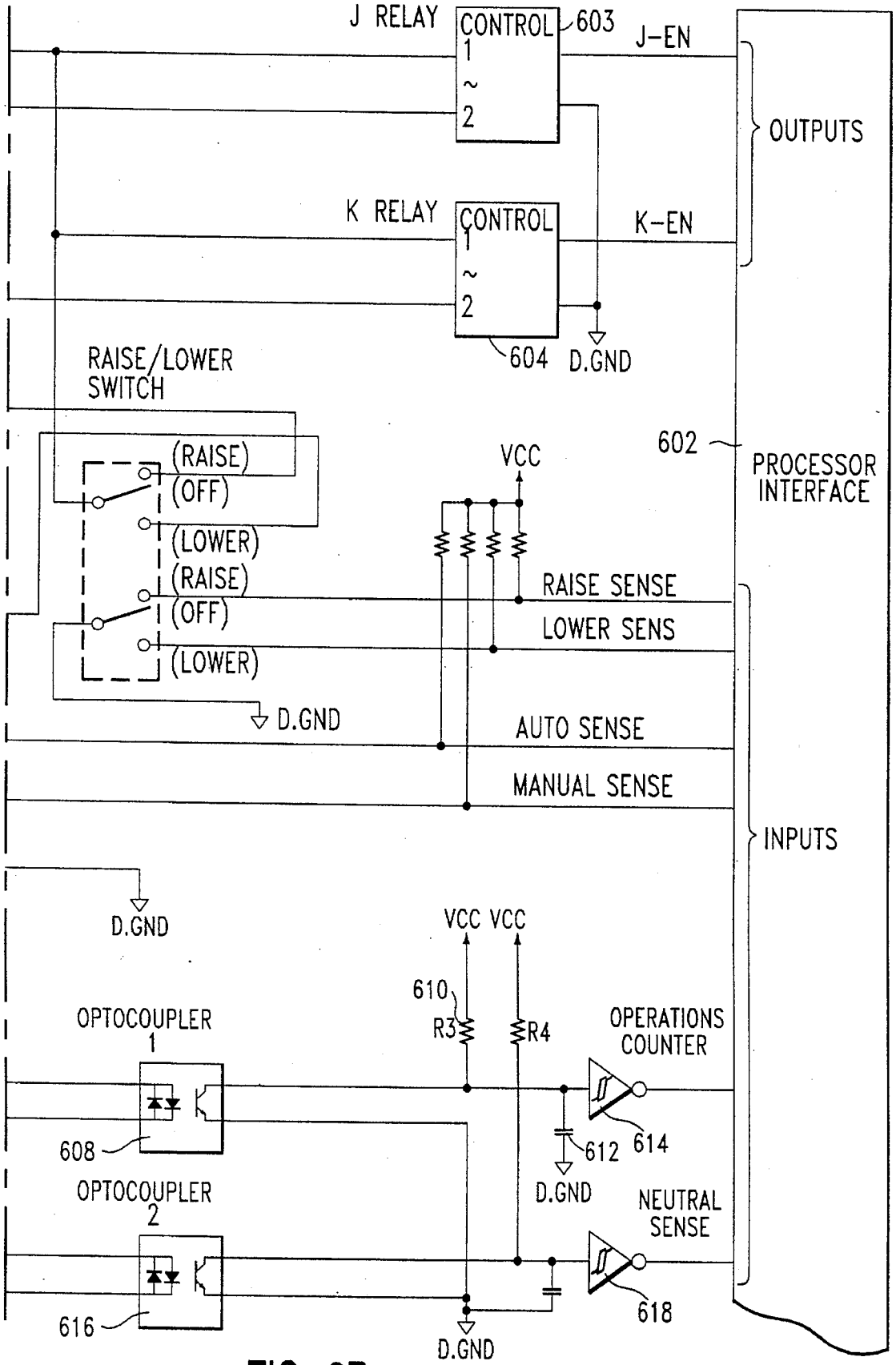

A more detailed diagram of the tap control and operations counter interface portion of the High Voltage interface 314 is shown in FIG. 6. The High Voltage Interface is coupled to the processor section by way of a processor interface connector 602. The processor interface connector mates with the high voltage interface signal connector 526 on the processor section. The microprocessor generates tap raise and lower control signals referred to as J enable and K enable respectively. The J enable and K enable signals each control a respective relay 603, 604 which generate the actual J (raise) and K (lower) command signals at the proper voltage and current level for the tap changing mechanism 404. An auto/manual switch 606 (which can be operated from the front panel) selects whether the tap changer is to be controlled by the processor generated raise (J enable) and lower (K enable) signals or by a user via a manually operated raise/lower switch 608 (accessible on the front panel). All raise and lower command signals (both manual and auto), a neutral sense signal and the state of the auto/manual switch 606 are monitored by the microprocessor 334. The Operations Counter input circuit uses a hi-directional opto-coupler 608, with one side connected to AC-hot and the other side connected to the Operations Counter input (U10). When the Operations Counter switch 338 is closed, current flows through the bi-directional opto-coupler's light emitting diodes, activating the opto-coupler's photo-transistor. When the Operations Counter switch 338 is open, no current flows through the opto-coupler's light emitting diode, and the opto-coupler's photo transistor output is off.

The opto-coupler's photo-transistor output is connected to an external pull-up resistor 610 and a filtering capacitor 612. When the photo-transistor activates, the signal is at a low logic level. When the photo-transistor is off, the signal is at a high logic level. The opto-coupler' output is connected to a Schmitt trigger inverter 614, which further filters the signal, making it a clean logic-level signal. The Schmitt trigger inverter's output is connected to an input of the microprocessor. The high voltage interface also includes a second opto-coupler 616 and Schmitt trigger inverter 618 which generated the neutral sense signal. The neutral sense signal indicates (to the microprocessor) when the tap is in the neutral position.

Figure 7:
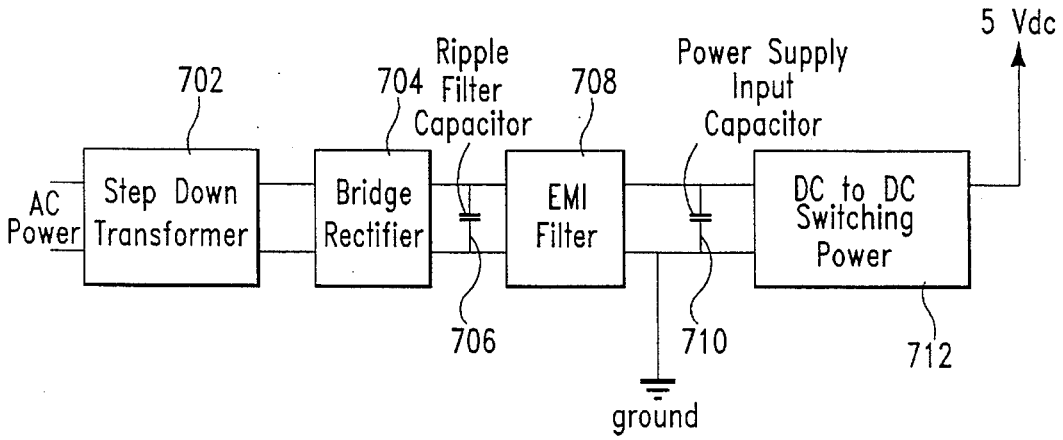
FIG. 7 is a block diagram of a power supply circuit according to an embodiment of the present invention.

A block diagram of the regulator controller's power supply is shown in FIG. 7. The power supply includes a step-down transformer 702 coupled to a bridge rectifier 704. The output of the bridge rectifier 704 is filtered by a first capacitor (ripple filter capacitor) 706 and provided to an electromagnetic interference (EMI) filter 708. The output of the EMI filter 708 is filtered by a second capacitor (power supply input capacitor) 710 and provided to the input of a DC to DC switching power supply circuit 712. The DC to DC switching power supply circuit provides a filtered 5 V DC output to the processor board.

A number of the power supply elements also serve as energy storage elements that extend the viability of the 5 V DC supply. The ripple filter capacitor 706 is such an energy storage element. The electro-magnetic interference (EMI)

filter 708 (which includes a common mode choke) also provides some energy storage capability. Further, the power supply input capacitor 710 also provides energy storage for the DC to DC switching power supply. The DC to DC switching supply operates down to approximately 8 V DC input, thus providing additional operating time for the 5 V DC supply.

As previously described, after shutting off all other active tasks, the power monitoring task saves the operations counter value to the serial EEPROM 336. Storing data in the serial EEPROM device takes approximately 10 milliseconds. Thus, the total time required for the 5 V DC supply to remain viable is roughly: (3×25 msec)+10 msec=85 msec.

Figure 8:
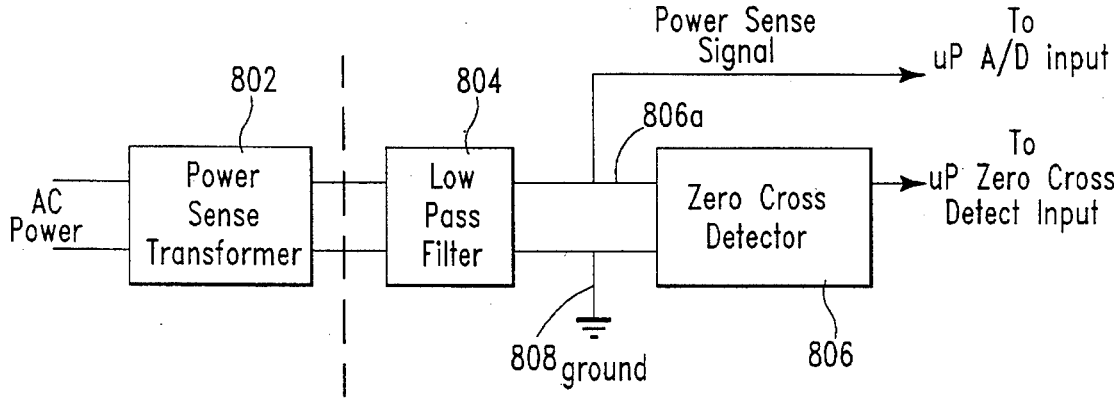
FIG. 8 is a block diagram of a power down sense circuit according to an embodiment of the present invention; and, FIG. 9 is a circuit diagram of the power down sense circuit if FIG. 8.

A block diagram of the power down sensor 337 is shown in FIG. 8. The power down sensor 337 is embodied using a zero-cross detector. The input to the zero-cross circuit is a transformer-coupled, scaled and filtered version of the AC power source. A block diagram of the power down sense circuitry is shown in FIG. 8.

The power down sensor 337 can be embodied as part of the analog sense signal interface 536. The power down sensor 337 is coupled to a power sense transformer 802 (located on the High Voltage Interface 314) which scales down the AC signal to about a 4 volt peak-to-peak signal. The scaled down signal is then passed through a low pass filter 804 and provided to a zero-cross detector circuit 806 (which is embodied as an inverting voltage comparator circuit that provides a high level of hysteresis). When the applied AC power source falls below approximately 75 V, the voltage comparator's input signal does not have sufficient amplitude to make the output change state.

A Zero Cross Detector 806, embodied as a voltage comparator circuit, compares the input signal to the mid-point of the incoming AC waveform. For the comparator output to change from a high to a low state, the input waveform must be of sufficient positive amplitude to exceed the reference voltage at the voltage comparator's "+" input 806*a*. The reference voltage on the voltage comparator, (determined by the voltage comparator's output voltage and by the values of its feedback and bias resistors), is pulled higher than analog ground 808 when the output is high, and lower than analog ground when the output is low.

Figure 9:
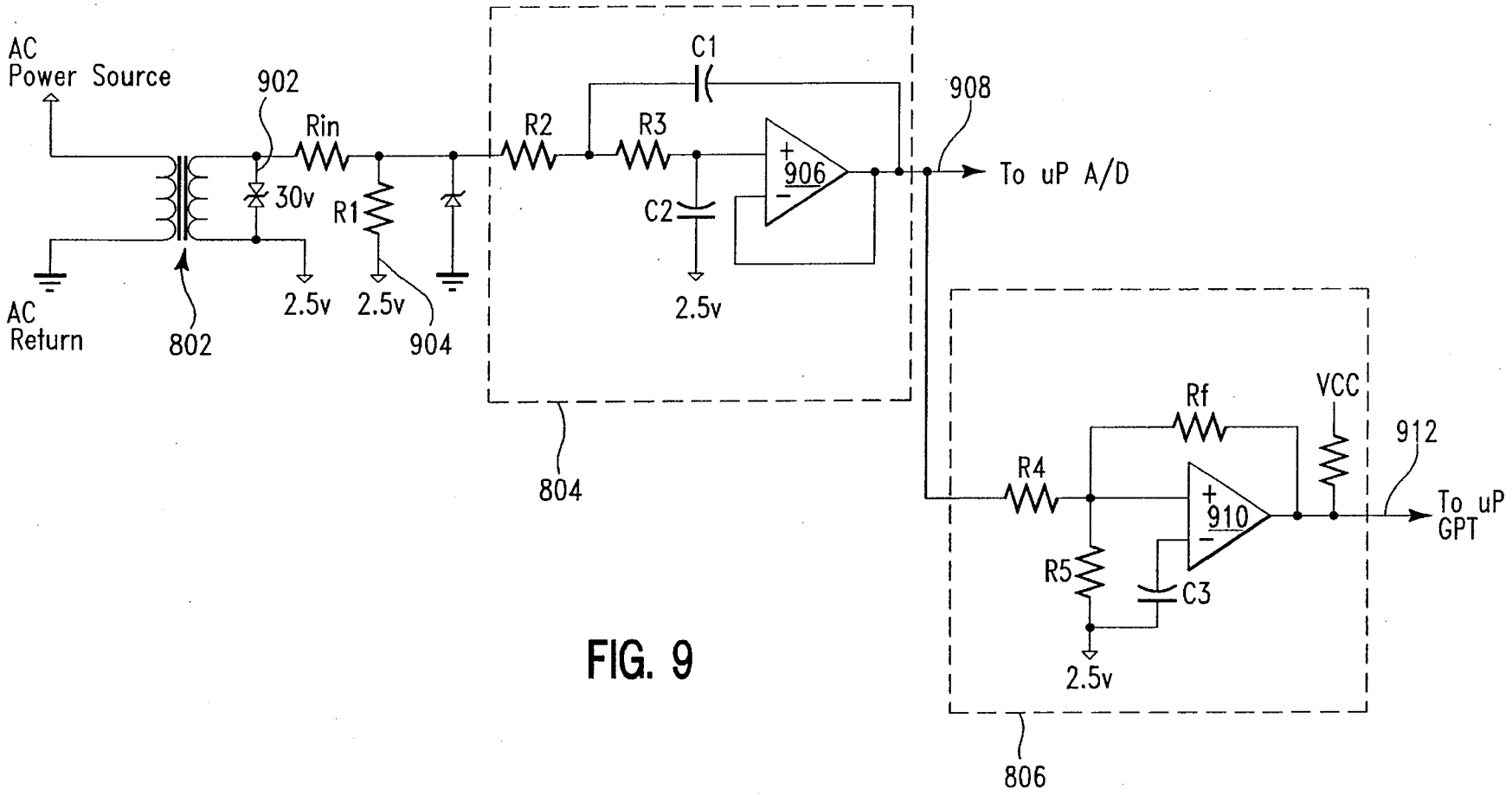

A circuit diagram of the power down sensor 337 is shown in FIG. 9. The power sense transformer 802 scales down the AC signal to about a 4 volt peak-to-peak signal. A surge protection device 902 protects the electronics from transients generated on the AC supply side of the sense transformer 802. Two resistors, Rin and R1, provides additional scaling of the sense signal, as well as a fixed load impedance for the sense transformer. A zener diode protects 904 the electronics from damage due to overvoltage. An operational amplifier 906, resistors R2, R3 and capacitors C1, C2 form a 2-pole Sallen-Key low pass filter 804. The low pass filter limits 804 the maximum frequency of the signal so that aliasing of the sampled signal is minimized. The output of the low pass filter goes to two places: the microprocessor analog to digital converter input 334*c* (via line 908) for sampling, and to the zero cross detector circuit 806.

The microprocessor 334 samples the scaled, filtered version of the AC power signal and determines its RMS voltage.

The zero cross detector circuit 806 consists of a voltage comparator 910, resistors R4, R5, Rf and a capacitor C3. R4 and C3 form a single pole low pass filter. This filter reduces signal content above the desired maximum component of approximately 63 Hz. The circuit topology is arranged to implement an inverting comparator with hysteresis. The amount of hysteresis is dependent on the values of R5 and Rf. In the present embodiment, R5 and Rf are selected so that, with an AC input voltage of approximately 75 VAC, transitions cease occurring at the zero cross detector output.

The zero cross detector output (line 912) connects to the zero cross input. This input circuit is an "input capture" type input. The zero cross input can be embodied as one of the microprocessor's General Purpose Timer (GPT) inputs 334*e*.

Whenever the microprocessor detects a transition at the zero cross input, it copies the value of its internal free-running counter into a special input capture timer register. Using consecutively stored timer register values (which are stored each time an input transition occurs), the microprocessor determines the frequency of the zero cross input signal.

Also, as previously described, each time a signal transition occurs, the processor program is interrupted. The interrupt service routine is called to respond to the interrupt. As part of the interrupt response, the "Power Loss Counter" (described with respect to FIG. 2) is cleared.

Now that the invention has been described by way of the preferred embodiment, various modifications, enhancements and improvements which do not depart from the scope and spirit of the invention will become apparent to those of skill in the art. Thus, it should be understood that the preferred embodiment has been provided by way of example and not by way of limitation. The scope of the invention is defined by the appended claims.

I claim:

1. An apparatus for maintaining an operations count in a voltage regulation system having a step-type voltage regulator transformer and a tap changer mechanism of a type which can be operated by an automated controller, said apparatus comprising:

a power supply for providing power to the controller;

monitoring means for detecting each time a tap change is made by the tap changer mechanism;

counting means for incrementing a stored value each time a tap change is detected so as to maintain an electronically stored count value; and power supply monitor means for monitoring the power supply, said power supply monitor means including means for determining when a failure of said power supply is imminent and for storing the count value in a non-volatile memory in response to a determination that the failure is imminent.

2. The apparatus of claim 1, further comprising:

tap position storage means, coupled to the power supply monitor means, for storing a power-down tap position of the voltage regulator transformer in the non-volatile memory along with a time and date stamp indicative of when the current tap position was stored;

comparison means for determining a present time and date when power is initially applied to the voltage regulator controller, determining a present time and date and for comparing the time and date stamp with the present time and date to determine an age of the power-down tap position stored in the non-volatile memory; and, tap position determination means for storing the power down tap position as a present tap position when the age of the power-down tap position does not exceed a maximum allowable age value and otherwise clearing the present tap position and indicating to the controller that the present tap position is unknown.

3. The apparatus of claim 1 wherein the power supply monitor means comprises a zero-crossing detector circuit.

4. The apparatus of claim 3 wherein, the power supply further includes a means for maintaining an output voltage level for a sufficient time after the peak AC voltage has dropped below the predetermined threshold so as to enable the means for detecting to store the operations counter value.

5. The apparatus of claim 3 wherein the power supply maintains the output voltage level solely from energy stored in capacitive and inductive elements thereof.

6. The apparatus of claim 1 wherein, the power supply monitor means determines the imminent failure of the power supply and thereby causes the power supply monitor means to shut down controller functions not associated with powering down and storage of the count value.

7. An apparatus for maintaining an operations count in a voltage regulation system having a step-type voltage regulator transformer and a tap changer of a type which can be operated by an automated controller having a direct current power supply, comprising:

zero-cross means for continuously monitoring an alternating current input to the direct current power supply for zero crossings;

a counter;

increment means for periodically incrementing the counter;

reset means, coupled to the zero-cross means, for resetting the counter each time one of the zero-crossings occurs;

a comparator for comparing a current counter value with a threshold value; and, storage means for storing the operations count in a non-volatile memory when the current counter value exceeds the threshold value.

8. The apparatus of claim 7 further comprising:

task scheduler means, coupled to the comparator means, for discontinuing software tasks executing on the controller when the comparator exceeds the threshold value.

9. The apparatus of claim 7, further comprising:

tap position storage means, coupled to the comparator, for storing a power-down tap position of the voltage regulator transformer in the non-volatile memory along with a time and date stamp indicative of when the current tap position was stored when the current counter value exceeds the threshold value;

comparison means for determining a present time and date when power is initially applied to the voltage regulator controller, determining a present time and date and for comparing the time and date stamp with the present time and date to determine an age of the power-down tap position stored in the non-volatile memory; and, tap position determination means for storing the power down tap position as a present tap position when the age of the power-down tap position does not exceed a maximum allowable age value and otherwise clearing the present tap position and indicating to the controller that the present tap position is unknown.

10. A method of maintaining an operations count in voltage regulation system having a step-type voltage regulator transformer and a tap changer of a type which can be operated by an automated controller having a direct current power supply, comprising the steps of:

continuously monitoring an alternating current input to the direct current power supply for zero crossings;

periodically incrementing a counter;

clearing the counter each time one of the zero-crossings occurs; and, when the counter exceeds a threshold value, storing the operations count in a non-volatile memory.

11. The method of claim 10 comprising the further step of:

when the counter exceeds the threshold value, discontinuing software tasks executing on the controller.

12. The method of claim 10 comprising the further steps of:

when the counter exceeds the threshold value, storing a power-down tap position of the voltage regulator transformer in the non-volatile memory along with a time and date stamp indicative of when the current tap position was stored, when power is initially applied to the voltage regulator controller, determining a present time and date;

comparing the time and date stamp with the present time and date to determine an age of the power-down tap position stored in the non-volatile memory; and, when the age of the power-down tap position does not exceed a maximum allowable age value, using the power-down tap position as a current tap position and otherwise clearing the current tap position.

* * * * *